US005378591A

United States Patent [19]

Droin et al.

[11] Patent Number: 5,378,591

[45] Date of Patent: Jan. 3, 1995

[54] REVERSAL COLOR PHOTOGRAPHIC MATERIAL

[75] Inventors: Gérard M. Droin, Beaune; Simone J. Kempen, Calliat, both of France

[73] Assignee: Eastman Kodak Company, Rochester, N.Y.

[21] Appl. No.: 962,808

[22] PCT Filed: Jul. 2, 1991

[86] PCT. No.: PCT/EP91/01234

§ 371 Date: Mar. 13, 1993

§ 102(e) Date: Mar. 13, 1993

[87] PCT Pub. No.: WO92/01242

PCT Pub. Date: Jan. 23, 1992

[30] Foreign Application Priority Data

Jul. 4, 1990 [FR] France ..... 9008786

[51] Int. Cl.[6] ..... G03C 1/46

[52] U.S. Cl. ..... 430/506; 430/503; 430/567; 430/379

[58] Field of Search ..... 430/567, 506, 503, 379

[56] References Cited

U.S. PATENT DOCUMENTS

| | | | |
|---|---|---|---|
| 3,174,861 | 3/1965 | Himmelmann et al. | 96/111 |
| 3,206,313 | 9/1965 | Porter et al. | 96/108 |
| 3,505,068 | 4/1970 | Beckett et al. | 96/68 |
| 3,574,628 | 4/1971 | Jones | 96/107 |
| 3,761,276 | 9/1973 | Evans | 96/108 |
| 3,779,764 | 12/1973 | Moll et al. | 96/59 |
| 4,554,245 | 11/1985 | Hayashi et al. | 430/567 |
| 4,640,890 | 2/1987 | Fujita et al. | 430/504 |
| 4,670,375 | 6/1987 | Michiue et al. | 430/509 |
| 4,727,016 | 2/1988 | Bando | 430/567 |
| 4,792,518 | 12/1988 | Kuwashima et al. | 430/506 |
| 5,118,597 | 6/1992 | Mihayashi et al. | 430/567 |
| 5,188,928 | 2/1993 | Karino et al. | 430/510 |

FOREIGN PATENT DOCUMENTS

| | | |
|---|---|---|
| 193179 | 2/1986 | European Pat. Off. . |
| 356077 | 2/1990 | European Pat. Off. . |
| 1597840 | 8/1970 | France . |
| 2220810 | 3/1973 | France . |
| 3529375 | 2/1986 | Germany . |
| 732691 | 11/1952 | United Kingdom . |
| 818687 | 8/1959 | United Kingdom . |
| 1027146 | 4/1966 | United Kingdom . |
| 1586412 | 3/1981 | United Kingdom . |

OTHER PUBLICATIONS

"Some Aspects of the Reciprocity Law in Silver Chloride Emulsions" by P. Faelens, pp. 100–105, *Photographic Science & Engineering*, vol. 26, No. 2, Mar. 1982.

*Primary Examiner*—Charles L. Bowers, Jr.
*Assistant Examiner*—Geraldine Letscher
*Attorney, Agent, or Firm*—Gordon M. Stewart

[57] ABSTRACT

The present invention relates to a reversal color photographic material.

The material contains three elements which are photosensitive to the three regions of the spectrum respectively. Each element contains at least two emulsions having different speeds. In at least one of the elements, the fastest emulsion is a polydisperse emulsion exhibiting a sensitization higher than the optimum, the other emulsions being monodisperse emulsions.

Obtention of a material less sensitive to the processing conditions, without degradation of the other photographic properties.

13 Claims, No Drawings

REVERSAL COLOR PHOTOGRAPHIC MATERIAL

The present invention relates to a reversal color photographic material.

The silver halide materials, reversal or not, for the color reproduction generally include three blue, green and red-sensitive elements respectively which respectively provide the yellow, magenta and cyan components of the subtractive synthesis in the color image.

The reversal materials are those, which after being exposed, undergo a silver development of the latent image (black and white development), then a reversal, which consists in rendering developable the unexposed residual silver halides by means of a fogging exposure or a chemical fog, and subjecting these fogged silver halides to a color-forming development in the presence of a color developing agent and a coupler, the latter being generally incorporated into the reversal material.

Each sensitive element includes, in one or more layers, silver halide emulsions having different speeds. In general, the fastest emulsions comprise the coarsest silver halide grains whereas the slowest ones contain the smallest grains, although the speed differences may be adjusted in another way, for example by means of different chemical sensitizations.

Such emulsion mixtures sensitized to the same region of the visible spectrum, in one or more layers, are conventionally used in order to decrease the contrast and in general, to obtain the desired curve shapes, acting on the mixture proportions.

Thus, for example, British Patents 732,691 and 818,687 and German Patent 1,121,470 disclose mixtures of slow and fast emulsions, in the same layer or in separate layers of color photographic materials.

It is advantageous for such mixtures to use silver halide emulsions comprising grains exhibiting a narrow grain distribution, or monodisperse emulsions. Indeed, these emulsions can be prepared in a more reproducible way and by blending these monodisperse emulsions, the curve shapes can be adjusted according to the desired results.

Monodisperse emulsions, in the present disclosure, are emulsions which grain size distribution or variation coefficient (COV) is equal or less than 20%. The variation coefficient is represented by the formula:

$$COV = \frac{\sigma}{D} \times 100$$

wherein $\sigma$ is the standard deviation and D the average grain size, represented by the average diameter when the grains are spherical and by the average value of the diameter of the circular images having the same surface as the projected images of the grains, when the grains are not spherical.

Methods for preparing monodisperse emulsions are disclosed, for example in U.S. Pat. No. 3,574,628 and British Patent 1,586,412; the latter patent mentions that such monodisperse emulsions can be used in any types of photographic materials, particularly in reversal color materials. In various patents, for example in French Patent 1,367,941 and U.S. Pat. No. 3,761,276, color photographic materials are disclosed wherein all the emulsions are monodisperse.

However, the monodisperse emulsions exhibit the drawback that the coarse grain emulsions, having a grain size more than 1 $\mu$m, are very sensitive to the processing conditions, for example to the stirring and the developing agent ageing, and/or exhibit a slow color development kinetics with some couplers.

These developability problems associated to monodisperse emulsions are well known and it has already been attempted to solve them.

For example, U.S. Pat. No. 4,640,890 discloses a reversal color photographic material wherein all the slow emulsions are monodisperse emulsions, the size distribution of the fast emulsions being not critical. Color photographic materials wherein a mixture, in one or more layers, of polydisperse and monodisperse emulsions is used, are disclosed for example in U.S. Pat. Nos. 4,554,245, 4,670,375, and 4,727,016. However, it was observed that, with such materials, reciprocity law failures cannot be reduced as they are advantageously when all the emulsions are monodisperse. Moreover, it can be seen according to the comparative examples of U.S. Pat. No. 4,640,890, that this structure does not provide satisfactory results with respect to the sensitivity to the processing conditions. In order to overcome this difficulty, U.S. Pat. No. 4,640,890 teaches to add an auxiliary layer outermost from the support, containing a light-insensitive silver halide emulsion formed of at least 75 mol % silver chloride.

The present invention allows to solve the processing sensitivity problem associated to the use of monodisperse emulsions, without loosing the advantages of these emulsions, and without needing to add a further layer, which complicates the manufacture and increases the cost.

It was found that this object can be achieved using, in a reversal color photographic material, a structure wherein at least one of the fastest emulsions is a polydisperse emulsion, the others being monodisperse emulsions, provided that the chemical and spectral sensitization of the polydisperse emulsion be "pushed" compared to a similar optimally sensitized control emulsion. One could have expected that the use of a polydisperse emulsion would have resulted in loosing all the advantages associated to the monodisperse emulsions, such as the possibility to adjust more readily the curve shapes. On the other hand, it is known that if the sensitisation of an emulsion is "pushed", it results in fogging and/or bad keeping properties of the emulsion. It is surprising that "pushing" the chemical and spectral sentitization of a polydisperse emulsion used as a fast emulsion allows to solve the processing sensitivity problem without deteriorating the other properties of the resulting photographic material, and without degrading the keeping properties.

The object of the present invention relates to a reversal color photographic material including, on a support, three blue-, green- and red- sensitive silver halide elements, each having associated therewith yellow, magenta and cyan dye-forming compounds respectively, each element containing, in a single layer or in separate layers, at least two emulsions having different speeds, and characterized in that, in at least one of the elements, the fastest emulsion is a polydisperse silver halide emulsion exhibiting a variation coefficient higher than 20%, the other emulsions being monodisperse emulsions exhibiting a variation coefficient less than 20%, said polydisperse emulsion being chemically and spectrally sensitized such that, by exposure and Kodak Ektachrome R-3 processing of a photosensitive element containing said polydisperse emulsion alone and the dye-forming coupler corresponding to the color sentitization of the emulsion, a sensitivity, for a 0.8 density, at least 0.10 log H higher than the sensitivity of an optimally chemically and spectrally sensitized control, is obtained, and preferably higher than 0.20 log H and a reciprocity failure equal to or less than $+-0.20$, preferably less than $+-0.10$, and more preferably less than $+-0.05$.

The optimally chemically and spectrally sensitized control is a polydisperse emulsion similar to the one used in the invention material, which is sulfur and gold sensitized in the presence of thiocyanate in order to obtain the best sensitivity/fog compromise, the fog being minimum, as indicated in Glafkides, 5th edition, page 463, in order to optimize the emulsion sensitivity. At the end of the chemical ripening, the minimum amount of sensitizing dye allowed to obtain the optimal spectral sensitization of the emulsion is added thereto.

The reciprocity failure is expressed in log H as being the difference between the exposures required to obtain a 0.8 density, with an exposure time of 0.5 s and an exposure time of 50 s.

The polydisperse silver halide emulsion can be prepared by conventional methods such as those disclosed in Mees, The Theory of the Photographic Process, and P. Glafkides, Chimie et Physique Photographiques. The emulsions can be prepared in an acidic, neutral or ammoniacal medium, by single or double jet.

The high speed emulsion of the reversal material according to the invention preferably comprises silver halide grains having an average size ranging for example, from 0.5 to 1.5 μm. The grains can include silver bromide, silver chlorobromide, silver bromoiodide, silver chloroiodobromide. The grain shape can be anyone among the cubic, octahedral, tetrahedral, tabular shapes, etc. The emulsion can be precipitated in presence of a metal salt, as indicated in *Research Disclosure,* December 1989, item 308119, Paragraph ID. In a preferred embodiment, the polydisperse emulsion is prepared by a single jet in presence of ammonium hydroxide and is doped with an iridium salt and it contains silver bromoiodide grains having a iodide content less than 10 mole % and preferably ranging from 3 to 5 mole % of the total halide, and an average grain size widely distributed around 0.8 μm.

As previously indicated, in this invention, the use of a polydisperse emulsion is facilitated by "pushing" the chemical sensitization and/or spectral sensitization. As it is known in the art, "pushing" the chemical sensitization can be provided by a higher ripening temperature, a longer ripening time, higher levels of chemical sensitizing agents or increases in addenda such as thiocyanate. "Pushing" the spectral sensitization can be provided for example by increasing the level of spectral sensitizing dye. In the invention, the terms "higher sensitization" or "pushed sensitization" mean that at least two of the above listed parameters are at least increased by 30% with respect to the control emulsion as previously defined. Preferably, two of the following parameters: ripening time, thiocyanate amount and sensitizing dye amount are at least increased by 30% and more preferably the three of them.

Typically, the preferred polydisperse emulsion such as above disclosed and acting as control, is sensitized by means of sodium thiosulfate and potassium tetrachloroaurate, at 65° C. during 5 minutes, in the presence of sodium thiocyanate and 100 to 150 mg of sensitizing dye per Ag mole depending on the nature of the sensitizing dye.

Of course, it is well understood that the optimum sensitization of the emulsion acting as control can vary depending on the nature of the polydisperse emulsion which is used and the nature of the sensitizing dye as is well known in the art. For example, *Research Disclosure,* December 1989, item 308119, paragraph IIIA provides a list of useful chemical sensitizing compounds and in paragraph IV, a list of spectral sensitizers.

In the reversal color photographic material according to the invention, at least one of the fastest emulsions comprises the above mentioned polydisperse emulsion exhibiting a higher sensitivity. The other emulsions are monodisperse emulsions the size of which varies depending on the desired speed. The monodispersibility of an emulsion has been previously defined. Monodisperse emulsions can be conventionally prepared, for example, as mentioned above for the polydisperse emulsions. For example, it is known to prepare monodisperse emulsions by means of a double jet precipitation in presence of a silver halide solvent such as a thioether, a thiourea or a thiocyanate. Core and shell emulsions can also be used, wherein the core and the shell have respectively a different halide composition, for example the core and the shell are formed of silver bromoiodide and the shell contains a lower level of iodide than the core, or no iodide. Such emulsions are disclosed, for example, in U.S. Pat. Nos. 3,206,313 and 3,505,068 and in French Patent 1,367,941. The grains can include silver bromide, silver bromoiodide, silver chlorobromide and silver chloroiodobromide. The grain shape can be any one among the cubic, octahedral, tetrahedral, tabular shapes, etc. The emulsion can be precipitated in presence of a metal salt, as mentioned in *Research Disclosure,* December 1989, item 308119, paragraph ID.

In a preferred embodiment, the monodisperse emulsions are octahedral silver bromoiodide emulsions having a total iodide content less than 10%, and preferably from 3 to 5 mole %, and doped with iridium.

The monodisperse emulsions are chemically and conventionally sensitized as mentioned in *Research Disclosure,* December 1989, item 308119, paragraph IIIA and spectrally sensitized, as mentioned in the same reference, paragraph IV.

Each element of the material according to the invention, sensitized to the same portion of the visible spectrum, includes at least two emulsions, and preferably three emulsions having different speeds, i.e. a fast and a slow emulsion, or a fast, a medium and a slow one. These emulsions are blended in a single layer or incorporated in separate layers.

In an embodiment of the invention, the polydisperse emulsion exhibiting a higher sensitization is the fastest blue-sensitized emulsion, and conventionally, it is located in the emulsion layer which is the outermost from the support.

In another embodiment, the polydisperse emulsion exhibiting a higher sensitization is the fastest green-sensitized emulsion.

In another embodiment, the two fastest blue and green-sensitized emulsions are polydisperse emulsions exhibiting a higher sensitization.

The fastest red-sensitized emulsion can also be a polydisperse emulsion exhibiting a higher sensitization. However, in this case, the developability and processing sensitivity problems are less critical, because generally these emulsions include smaller grains.

In any case, the fastest highly sensitized polydisperse emulsion is used having associated therewith one or two slower monodisperse emulsions. The proportions for each emulsion and their speed (according to their size) are adjusted according to the desired sensitometric curve shape, i.e. according to the desired contrast in each portion of the curve.

The photographic material according to the invention can further include antifogging agents and stabilizers as disclosed in *Research Disclosure,* December 1989, item 308119, paragraph VI, brighteners such as disclosed in paragraph V, plasticizers and lubricants such as disclosed in paragraph XII, matting agents such as disclosed in paragraph XVI, hardeners such as disclosed in paragraph X, coating additives such as disclosed in paragraph XI, absorbing and diffusing compounds such as disclosed in paragraph VIII.

It also contains dye-forming compounds or couplers, such as disclosed in paragraph VII of the same publication.

The reversal material of the present invention includes a support disclosed in the above-mentioned reference, paragraph XVII.

The reversal material according to the invention can be exposed, then processed, such as disclosed in the abovementioned publication, paragraph XIX,D.

The following examples illustrate the invention.

EXAMPLES 1 to 7

These examples describe the obtention of a polydisperse emulsion exhibiting a "pushed sensitization" according to the invention, with a first blue sensitizing dye A having the formula indicated below.

A fast yellow ammoniacal bromoiodide polydisperse emulsion was prepared; this emulsion was iridium doped. Average grain size was 0.8 μm, representative of emulsions used in commercial reversal materials.

The emulsion was divided into eight portions, each portion was gold and sulfur sensitized at 65° C. in the presence of sodium thiosulfate and the blue sensitizing dye A was added at the end of the chemical ripening.

Table I below indicates the relative ripening time and the relative amounts of thiocyanate and dye used. In this table, the NaSCN and dye amounts and the ripening times are expressed versus the NaSCN amount, the dye amount and the ripening times of the control which was optimally chemically and spectrally sensitized and to which the value 1 was attributed for simplification purposes.

TABLE I

| Samples | NaSCN | Ripening time | Dye A |
|---|---|---|---|
| Control | 1 | 1 | 1 |
| Example 1 | 2 | 1 | 2 |
| Example 2 | 1 | 2 | 2 |
| Example 3 | 3 | 3 | 1 |
| Example 4 | 1 | 3 | 3 |
| Example 5 | 2 | 2 | 3 |
| Example 6 | 2 | 3 | 2 |
| Example 7 | 2 | 2 | 2 |

A yellow coupler dispersion was incorporated into the eight emulsions at a coupler concentration such that the final layer coverage was 7.4 mg/dm$^2$, and the compositions were applied on polyethylene coated paper supports, at 4.2 mg/dm$^2$ of silver. Two samples of each eight resulting materials were exposed with white light to a step tablet, one during 0.5 s and the other during 50 s. The 16 samples were processed according to the Kodak Ektachrome R-3 processing, and their sensitometric curves in the blue were plotted.

The relative sensitivity expressed in log exposure with respect to the control to which the value 0 was attributed, for the sample exposed during 0.5 s and the reciprocity failure expressed as indicated above, are reported in Table II below.

TABLE II

| Samples | Log H relative sensitivity | LogH reciprocity failure |
|---|---|---|
| Control | 0 | −0.22 |
| Example 1 | 0.15 | −0.05 |
| Example 2 | 0.13 | −0.08 |
| Example 3 | 0.17 | −0.04 |
| Example 4 | 0.19 | −0.10 |
| Example 5 | 0.23 | −0.05 |
| Example 6 | 0.23 | −0.02 |
| Example 7 | 0.23 | −0.05 |

EXAMPLES 8 to 14

This example illustrates an emulsion exhibiting a "pushed sensitization" according to the invention with a mixture of two blue-sensitizing dyes B and C having the formulae indicated below.

Eight emulsions were prepared as in example 1; the ratio of the two sensitizing dyes B and C was in all examples 2/3 - 1/3. Table III below indicates the sensitization parameters, expressed as in Table I.

TABLE III

| Samples | NaSCN | Ripening time | B + C dyes |
|---|---|---|---|
| Control | 1 | 1 | 1 |
| Example 8 | 1 | 2 | 2 |
| Example 9 | 2 | 1 | 2 |
| Example 10 | 2 | 2 | 1 |
| Example 11 | 3 | 2 | 2 |
| Example 12 | 2 | 3 | 2 |
| Example 13 | 2 | 2 | 2 |
| Example 14 | 2 | 2 | 3 |

The emulsions were coated on a support, exposed and processed as in Example 1.

The following data were obtained:

TABLE IV

| Samples | Log H relative sensitivity | LogH reciprocity failure |
|---|---|---|
| Control | 0 | −0.27 |
| Example 8 | 0.12 | −0.17 |
| Example 9 | 0.24 | −0.16 |
| Example 10 | 0.21 | −0.07 |
| Example 11 | 0.21 | −0.01 |
| Example 12 | 0.22 | −0.08 |
| Example 13 | 0.23 | −0.10 |
| Example 14 | 0.30 | −0.04 |

EXAMPLES 15 to 20

The procedure of Example 1 was repeated, but with the green sensitizing dye D which formula is given below.

Table IV gives the variable sensitization parameters, the others being the same as in Example 1.

TABLE V

| Samples | NaSCN | Ripening time | D Dye |
|---|---|---|---|
| Control | 1 | 1 | 1 |
| Example 15 | 1.7 | 3 | 1 |

TABLE V-continued

| Samples | NaSCN | Ripening time | D Dye |
|---|---|---|---|
| Example 16 | 1.3 | 2 | 1 |
| Example 17 | 1.3 | 2 | 1.1 |
| Example 18 | 1.3 | 2 | 1.3 |
| Example 19 | 1.7 | 2 | 1.1 |
| Example 20 | 1.7 | 3 | 1.3 |

Compositions containing respectively each of the above-mentioned emulsions and a dispersion of magenta coupler were prepared, at a concentration such that a final coverage of 4.4 mg/dm$^2$ of the applied layer was obtained. The compositions were coated on a support, and the resulting material was exposed and processed as in Example 1.

The data are indicated in the table VI below.

TABLE VI

| Samples | Log H relative sensitivity | Log H reciprocity failure |
|---|---|---|
| Control | 0 | −0.25 |
| Example 15 | 0.10 | −0.12 |
| Example 16 | 0.11 | −0.19 |
| Example 17 | 0.10 | −0.18 |
| Example 18 | 0.11 | −0.19 |
| Example 19 | 0.14 | −0.11 |
| Example 20 | 0.16 | −0.11 |

SENSITIZING DYES

DYE A

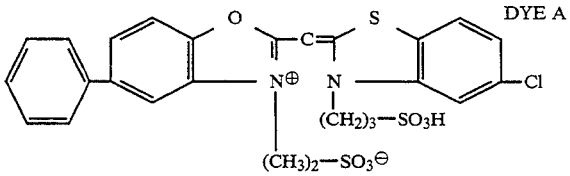

Dye B

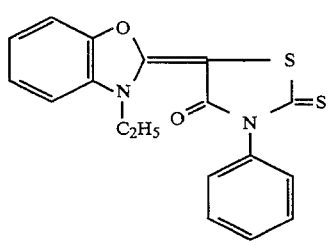

Dye C

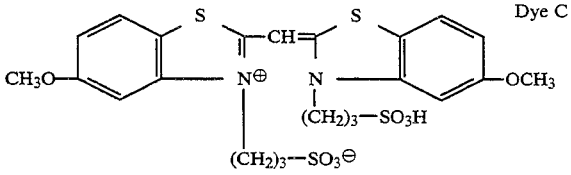

Dye D

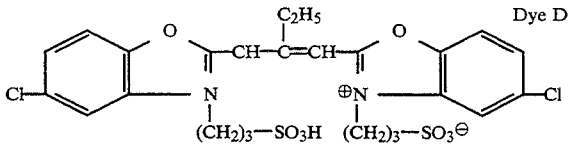

The following examples illustrate the use of a polydisperse emulsion exhibiting a "pushed sensitization" such as disclosed above acting as a fast emulsion in order to decrease the processing sensitivity of a reversal color photographic material containing monodisperse emulsions.

EXAMPLE 21

Three reversal color photographic materials were prepared, coating the following layers on a polyethylene coated paper support:

1 Overlayer=gelatin

2 Anti UV-layer

3 Blue sensitive layer associated with a yellow coupler

4 Carey-Lea colloidal silver

5 Green sensitive layer associated with a magenta coupler

6 Colloidal silver

7 Red sensitive layer associated with a cyan coupler 8 gelatin subbing layer Support Layer 3 was comprised of three blue-sensitive emulsions, fast, medium and slow, layers 5 and 7 are each comprised of monodisperse emulsions of different speeds.

In Control material A, the blue-sensitive emulsions were iridium doped silver bromoiodide monodisperse emulsions.

In Control material B, the fast emulsion of layer 3 was the control polydisperse emulsion of Table I, exhibiting a regularsensitization, the other emulsions being monodisperse emulsions like above.

In Example 21 material, the fast emulsion of layer 3 was the polydisperse emulsion of Example 6 exhibiting a "pushed sensitization" according to the invention, the other emulsions being monodisperse emulsions like above.

The resulting materials were exposed and processed according to the standard procedure of the Kodak Ektachrome R-3 processing.

The processing sensitivity is expressed as the difference of the yellow maximum densities for a color-forming processing time ranging between 105 s and 165 s. (The standard processing time is 135 s).

Table VII below indicates the resulting data, measured in the blue.

It can be seen in Example 21 that the processing sensitivity is improved as compared to Control A which only contains monodisperse emulsions, while keeping the reciprocity failure of this same Control A, which cannot be obtained if the sensitization of the polydisperse emulsions is not pushed, as shown by Control B.

TABLE VII

| Samples | Processing sensitivity 105 s–165 s Δ $D_{max}$ | Reciprocity failure 0,5–50 s Δ logH for d = 0,8 |
|---|---|---|
| Control A | 0,34 | −0,13 |
| Control B | 0,10 | −0,25 |
| Example 21 | 0,10 | −0,13 |

EXAMPLE 22

A material similar to Example 21 was prepared, except that the fast monodisperse emulsion of layer 5 was replaced by the polydisperse emulsion of Example 17 exhibiting a "pushed sensitization" according to the invention.

Control 15 was similar to the above-mentioned Control A.

After exposure and processing as in Example 21, the data indicated Table VIII below were obtained.

As in Example 21, the processing sensitivity was expressed as the Dmax difference for a color-forming processing time ranging from 105 s to 165 s. It is also expressed as being the density difference at the shoulder for a color-forming processing time ranging from 105 s to 165 s.

The shoulder density is represented by an exposure density 0.5 log H lower than the exposure providing a 0.8 density.

The keeping stability was measured as the Dmax and shoulder density differences when exposing and developing the fresh material and the material after keeping during a week at 50° C., in a sealed pocket.

A significant improvement in the processing sensitivity is evidenced for the material of Example 22 as compared to Control A which only contains monodisperse emulsions, without degradation of the keeping stability.

EXAMPLE 23

The materials of Example 22 and Control A were reproduced and were processed by 17 distinct R-3 processes in order to study the processing reproducibility. The 3 $\sigma$ standard deviations of the resulting data are indicated in the following Table IX.

TABLE VIII

| | Processing sensitivity (105–165 s) | | | | Reciprocity failure (0,5–50 s) | | Kept 1 week at 50° C. | | | |
|---|---|---|---|---|---|---|---|---|---|---|
| | $\Delta D_{max}$ | | $\Delta D$ shoulder | | $\Delta$ log H for d = 0,8 | | $\Delta D_{max}$ | | $\Delta D$ shoulder | |
| | Blue | Green | Blue | Green | Blue | Green | Blue | Green | Blue | Green |
| Control A | 0,34 | 0,28 | 0,16 | 0,06 | −0,13 | −0,13 | −0,06 | −0,08 | 0,04 | −0,08 |
| Example 22 | 0,10 | 0,07 | 0,02 | 0,02 | −0,10 | −0,10 | −0,07 | −0,07 | 0,05 | −0,07 |

TABLE IX

| | 3 $\sigma$ standard deviation Dmax | | 3 $\sigma$ standard deviation shoulder density | |
|---|---|---|---|---|
| | Blue | Green | Blue | Green |
| Control A | 0.339 | 0.265 | 0.164 | 0.159 |
| Example 22 | 0.173 | 0.188 | 0.088 | 0.101 |

It is established that the 3 $\sigma$ standard deviation rapidly decreases by half between Example 22 and Control A.

EXAMPLE 24

Materials similar to those of Example 22 and Control A were reproduced and processed during different times in the first black and white developer of the Kodak Ektachrome R-3 processing, in order to study the sensitivity of the materials to the development time in the first black and white developer of the R-3 processing. The data are expressed as shoulder density differences in the green, defined as in the above-mentioned Example 22, for a black and white processing time ranging from 60 s to 90 s and they are indicated in Table X below.

TABLE X

| | Shoulder density difference in the green 60 s–90 s |
|---|---|
| Control A | 0.08 |
| Example 22 | 0.01 |

It was observed that the material of Example 22 was less processing sensitive than Control A material.

We claim:

1. Reversal color photographic material comprising, on a support, three blue-, green- and red-sensitive silver halide elements, each having associated therewith yellow, magenta and cyan dye-forming compounds respectively, wherein each element contains, in a single or separate layers, at least one slower silver halide emulsion having a lower speed and one faster silver halide emulsion having a higher speed and wherein at least one of the elements contains as the faster silver halide emulsion a polydisperse silver halide emulsion having a variation coefficient higher than 20%, the other emulsions being monodisperse emulsions having a variation coefficient less than 20%, said polydisperse emulsion being chemically and spectrally sensitized such that, by exposure and Kodak Ektachrome R-3 processing of a photosensitive material containing said polydisperse silver halide emulsion alone and the coupler forming the substractive dye complementary of the color sensitization of said polydisperse silver halide emulsion, a sensitivity, at a 0.8 density, of at least 0.10 log H higher than the sensitivity of an optimally chemically and spectrally sensitized control, and a reciprocity failure equal to or less than +−0.20, are obtained.

2. The reversal color photographic material of claim 1, wherein the sensitivity of said polydisperse emulsion, for a 0.8 density, is at least 0.20 log H higher than the sensitivity of said optimally chemically and spectrally sensitized control.

3. The reversal color photographic material according to claim 1, wherein the reciprocity failure of said polydisperse emulsion is equal or less than +−0.10.

4. The reversal color photographic material according to claim 1, wherein the reciprocity failure of said polydisperse emulsion is equal or less than +−0.05.

5. The reversal color photographic material of according to claim 1, wherein the sensitization of the polydisperse emulsion is obtained, by increasing by at least 30% at least two of the three following parameters: the chemical ripening time of the emulsion, the thiocyanate amount and the amount of sensitizing dye.

6. The reversal color photographic material of according to claim 5, wherein the sensitization of the polydisperse silver halide emulsion is obtained, by increasing by at least 30% said three parameters at once.

7. The reversal color photographic material according to claim 1, wherein said polydisperse silver halide emulsion is an ammoniacal silver bromoiodide emulsion precipitated by single jet.

8. The reversal color photographic material according to claim 1, wherein each of the polydisperse silver halide emulsions and the monodisperse silver halide emulsions have a total iodide content ranging from 1 to 10%.

9. The reversal color photographic material according to claim 1, wherein the monodisperse silver halide emulsions are core-shell silver halide emulsions having a core formed of silver bromoiodide and a shell formed of silver bromide or silver bromoiodide, the iodide content of the shell being lower than in the core or equal to zero.

10. The reversal color photographic material according to claim 1, wherein in said material the blue sensitive element contains a fast blue-sensitive silver halide emulsion and at least a blue-sensitive slower silver halide emulsion, said fast blue-sensitive silver halide emulsion being formed of said polydisperse emulsion.

11. The reversal color photographic material according to claim 1, wherein in said material and the green-sensitive element contains a fast green-sensitive silver halide emulsion and at least a slower green-sensitive silver halide smulsion, said fast green-sensitive silver halide emulsion being formed of said polydisperse emulsion.

12. The reversal color photographic material according to claim 1, wherein in at least one of the blue-, green- or red-sensitive elements, wherein the fast polydisperse emulsion exhibiting a higher sensitization and the slower monodisperse emulsion, sensitized to the same region of the spectrum, are blended in a single layer.

13. The reversal color photographic material according to claim 1, wherein in at least one of the blue-, green- or red-sensitive elements, the fast polydisperse emulsion and the slower monodisperse emulsion, sensitized to the same region of the spectrum, are in separate layers.

* * * * *